US008484874B2

(12) United States Patent
Kim

(10) Patent No.: US 8,484,874 B2
(45) Date of Patent: Jul. 16, 2013

(54) SYSTEMS AND METHODS FOR RECEIVING AND LOADING CARTRIDGES IN BULK

(76) Inventor: Raymond Kyungjune Kim, Federal Way, WA (US)

( * ) Notice: Subject to any disclaimer, the term of this patent is extended or adjusted under 35 U.S.C. 154(b) by 38 days.

(21) Appl. No.: 13/083,547

(22) Filed: Apr. 9, 2011

(65) Prior Publication Data

US 2012/0255211 A1 Oct. 11, 2012

(51) Int. Cl.
*F41A 9/83* (2006.01)

(52) U.S. Cl.
USPC ..... 42/49.01; 42/90; 89/33.01

(58) Field of Classification Search
USPC ..... 42/49.01, 87, 88, 89; 86/45, 46, 86/47; 224/196
See application file for complete search history.

(56) References Cited

U.S. PATENT DOCUMENTS 452,447 A * 5/1891 Bruce ..... 42/88
1,840,477 A * 1/1932 Von Frommer ..... 42/88
2,783,570 A * 3/1957 Kunz ..... 42/87
6,754,987 B1 * 6/2004 Cheng et al. ..... 42/87
7,059,077 B2 * 6/2006 Tal et al. ..... 42/88
7,805,874 B2 * 10/2010 Tal et al. ..... 42/87
7,866,080 B2 * 1/2011 Tucker ..... 42/87
2005/0081421 A1 * 4/2005 Guy et al. ..... 42/88
2009/0044440 A1 * 2/2009 Tal et al. ..... 42/87
2010/0313460 A1 * 12/2010 Tucker ..... 42/87
2012/0192477 A1 * 8/2012 Kim ..... 42/87
2012/0222343 A1 * 9/2012 Kim ..... 42/88

* cited by examiner

*Primary Examiner* — Bret Hayes
*Assistant Examiner* — Joshua Freeman

(57) ABSTRACT

Systems and methods for receiving and loading cartridges in bulk are disclosed herein. A device described herein includes multiple parallel partition walls configured to couple with cartridge carriers and segregate, group and single file line the cartridges removed from the cartridge carriers and placed onto a receiving surface. An alignment wall on the receiving surface works in conjunction with the partition walls in aligning groups of cartridges into single files on the receiving surface. A loading rod slideably engaged with the receiving surface urges single filed groups of cartridges from the receiving surface into a magazine coupled with the receiving surface.

26 Claims, 7 Drawing Sheets

SYSTEMS AND METHODS FOR RECEIVING AND LOADING CARTRIDGES IN BULK

BACKGROUND OF THE INVENTION

For decades, ammunition cartridges packaged on stripper clips have assisted users in expediting the process for loading ammunition cartridges into magazines. Stripper clips facilitate the bulk loading of cartridges into magazines by keeping cartridges filed in single files which are easy to align with and load into the open ends of magazines. However, most ammunition cartridges available on the commercial market do not come packaged on stripper clips. Commercial ammunition cartridges often come packaged in cartridge carriers such as cardboard boxes and plastic trays which are economic to manufacture and package cartridges in. However, the tradeoff for this economy is the loss of ergonomics in being able to transfer cartridges from packaging into magazines quickly and easily.

In response to the relative difficulty of loading commercial packaged cartridges into magazines, the commercial market has developed an array of speed loading devices to assist users in transferring ammunition packaged in boxes or trays to magazines. However, the majority of these speed loading devices assist users only in pressing ammunition cartridges into magazines, but do not facilitate or speed up the process for transferring ammunition to the magazines. This means that users of current speed loading devices are required to transfer cartridges in boxes or trays onto speed loading devices or magazines by individual cartridges manually by hand. There are currently no devices which can receive ammunition cartridges directly from commercial boxes or trays in bulk for loading into magazines.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

Figure 1A:
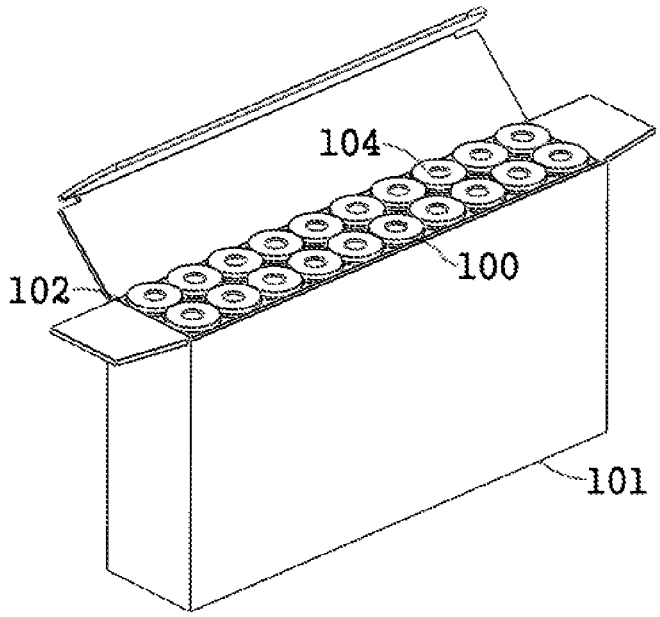
FIG. 1A is an angled side view of a box type cartridge carrier with cartridges.

The prior art method for loading cartridges stored in an cartridge carrier requires taking out individual cartridges from the cartridge carrier and loading them one by one into a magazine or onto a magazine speed loading device for loading into a magazine. As this is time and labor intensive, it is an object of an embodiment of the present invention to provide a system by which the cartridges contained on an ammunition carrier can be transferred directly from a cartridge carrier such as a box or tray onto a magazine speed loading device in bulk and then loaded into a magazine in bulk.

An example embodiment of the present invention is a process by which the cartridges on a cartridge carrier are placed in bulk onto a speed loading device where they are segregated into multiple groups, aligned into single files in their groups and loaded into a magazine. This process involves the use of multiple parallel partition walls on the speed loading device that move in tandem with one another on the speed loading device. The partition walls have distal narrow sides that couple with a cartridge carrier at a side of the cartridge carrier which exposes the cartridges in the cartridge carrier. The cartridge carrier is coupled to the partition wall distal narrow sides in such a manner that the cartridges on the exposed side of the cartridge carrier face into a receiving surface of the speed loading device. The partition walls segregate and compartmentalize the cartridges on the cartridge carrier into compartment spaces, defined by the partition walls, based on the vertical row configuration the cartridges are arranged in on the cartridge carrier, which is based on the orientation of the cartridge carrier to the partition walls. Opposite to the distal narrow sides are a set of proximal narrow sides on the partition walls which are slideably engaged with the receiving surface. The receiving surface is a generally elongated surface on the speed loading device that runs the length of the speed loading device and has two long edges and two short edges. The receiving surface is configured to receive and support cartridges displaced from the cartridge carrier, coupled to the partition wall distal narrow sides, by force of gravity. The receiving surface is also configured receive and support individual cartridges placed onto the receiving surface by hand. The cartridges displaced onto the receiving surface from the cartridge carrier are partially retained within the cartridge carrier while the cartridge carrier is coupled to the partition wall distal narrow sides. Upon decoupling of the cartridge carrier from the partition wall distal narrow sides and removing the cartridge carrier from tangency with the cartridges, cartridges gain the ability to move parallel to the length of the receiving surface on the receiving surface.

A proximal long edge on the receiving surface is coupled to an alignment wall running the length of the speed loading device. The alignment wall is configured to work in conjunction with the partition walls in successively leveling each group of cartridges segregated by the partition walls and displaced onto the receiving surface into single file rows which are parallel and adjacent with the alignment wall. Each partition wall successively urges the group of cartridges that is adjacent to it, that lies between it and the alignment wall, against the alignment wall and forms a temporary chamber with the alignment wall that is the width of a cartridge.

A magazine is engaged to the speed loading device at a proximal short edge of the receiving surface, located adjacent to the proximal long edge, in such a manner that the open end of the magazine is aligned with the successive files of cartridges aligned in the temporary chambers formed by the alignment wall and each of the partition walls. A loading rod, which is a generally elongate rectangular bar, is slideably engaged with the receiving surface at the distal short edge of the receiving surface, located opposite to the proximal short edge. The loading rod is configured to slide the length of the receiving surface, from the distal short edge to the proximal short edge, while in tangency with the alignment wall. The loading rod successively urges each successively filed group of cartridges in each successively formed chamber from the receiving surface into the open end of the coupled magazine. After each successive urging, the loading rod is withdrawn from the receiving surface and the partition wall that formed a chamber for the prior group of cartridges that have been urged from the receiving surface is urged through the alignment wall through an opening in the alignment wall. This allows a successive group of cartridges, following the prior cartridges, to be leveled against the alignment wall by urging of the partition wall that is adjacent to the successive cartridges, which has not been urged through the opening in alignment wall. As this and each subsequent partition wall forms a chamber with the alignment wall, the loading rod is continually reengaged with the receiving surface and urges cartridges into the open end of the coupled magazine until all cartridges on the receiving channel are urged from the receiving surface.

Figure 1B:
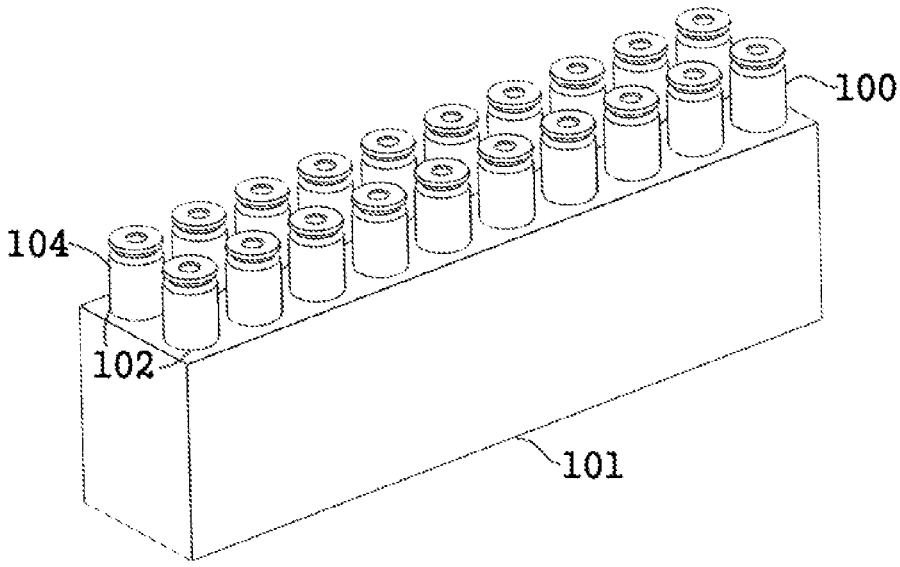
FIG. 1B is an angled side view of a tray type cartridge carrier with cartridges.

In reference to example embodiments disclosed in FIGS. 1A and 1B, a cartridge carrier 101 is a generally elongated rectangular box shaped container, also known as a box or tray, containing a single or multiple exposed holding compartments 102. Ammunition cartridges 100 are placed into the holding compartments 102 with either the bullet tips 103 or flat primer sides 104 placed foremost into the holding compartments 102. In one embodiment of the cartridge carrier 101, cartridge carriers 101 have a single row of multiple holding compartments 102. In another embodiment of the cartridge carrier 101, cartridge carriers 101 have a single holding compartment 102 which can host a single row of cartridges 100. In another embodiment of the cartridge carrier 101, cartridge carriers 101 have a single holding compartment 102 which can host multiple rows of cartridges 101. In another embodiment of the cartridge carrier 101, cartridge carriers 101 have multiple rows of holding compartments 102 arranged adjacent and parallel to one another with cartridges 100 placed into the holding compartments 102, cartridge bullet tips 103 inserted foremost into the holding compartment 102.

Figure 2A:
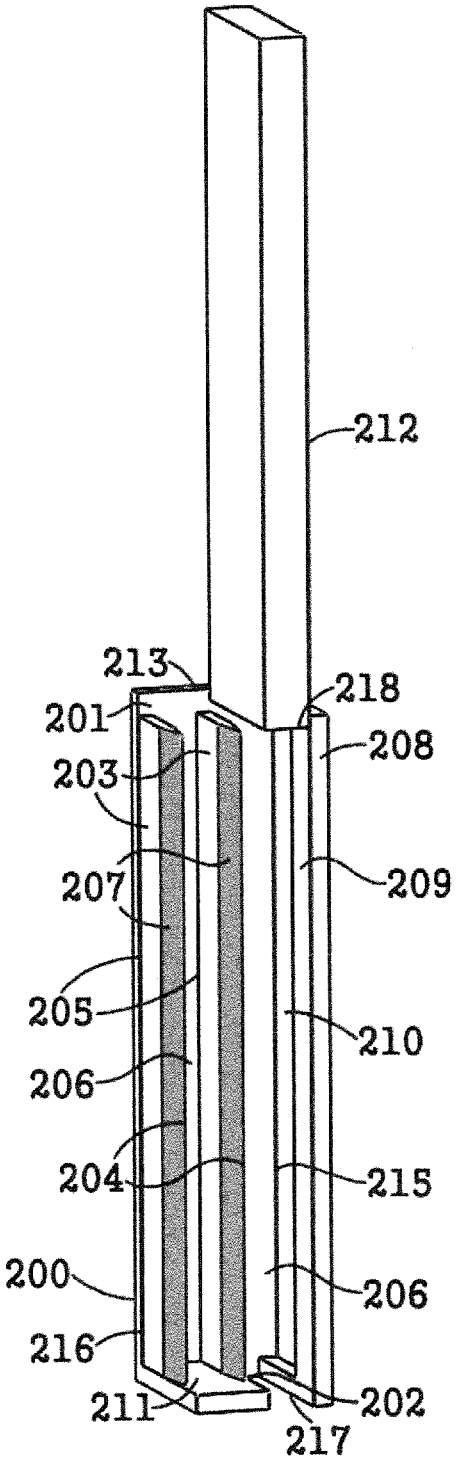
FIG. 2A is an angled side view of the of the preferred embodiment of the speed loading device.
Figure 2B:
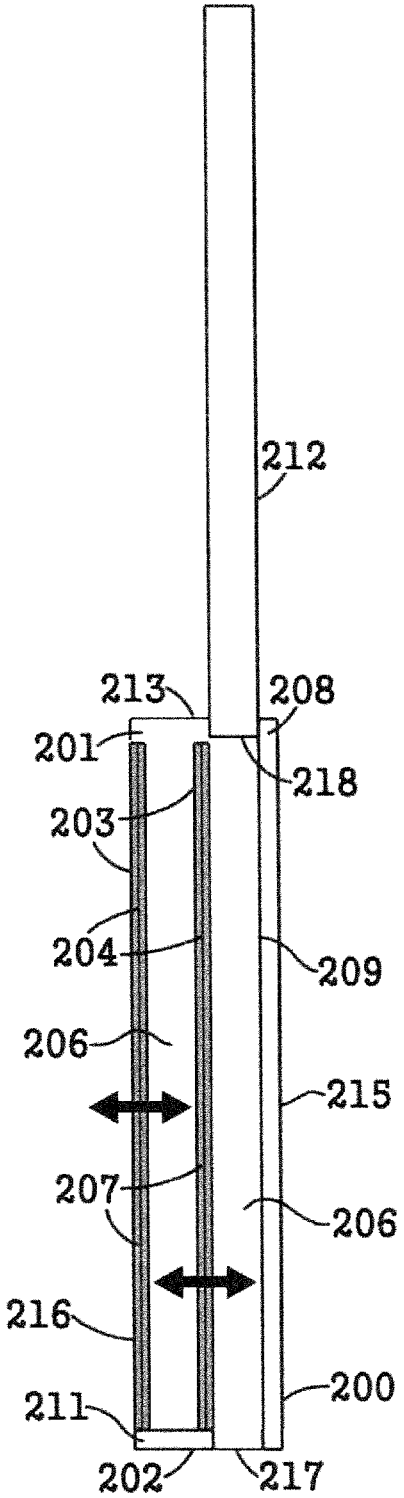
FIG. 2B is a frontal view of the preferred embodiment of the speed loading device.

In reference to example embodiments disclosed in FIGS. 2A and 2B, the speed loading device 200 is a generally elongated rectangular box shaped container which defines a receiving surface 201 that runs the length of the speed loading device 200 on a side of the speed loading device 200. The receiving surface 201 has a proximal short edge 202 located on a short edge, a distal short edge 213 located opposite to the proximal short edge 202, an adjacent long edge 215 located between the proximal short edge 202 and distal short edge 213, and an opposite long edge 216 located opposite of the adjacent long edge 215. The receiving surface 201 is configured to slideably engage with cartridges 100 placed onto it by loose individual cartridge 100 or placed onto it in bulk from a cartridge carrier 101, and guide cartridges 100 to the proximal short edge 202, which is configured to host the open end of a magazine 300. The speed loading device 200 further defines multiple partition walls 203 which have multiple proximal narrow sides 204 that are slideably engaged with the receiving surface 201. The partition walls 203 move laterally along the receiving surface 201 along the width of the speed loading device 200 while moving in tandem with one another. The partition walls 203, running parallel to one another, also run parallel to the length of the speed loading device 200 and are elongated perpendicularly to the receiving surface 201. The partition walls 203 are configured to segregate and compartmentalize the surface area of the receiving surface 201 into compartment spaces 206 defined by the partition walls 203. In an embodiment, the partition walls 203 consist of two sets of walls. The compartment spaces 206 on the partition walls 203 run the length of the partition walls 203 and in an embodiment segregate and maintain cartridges 100 in a single row configuration. In another embodiment, the compartment spaces 206 segregate and maintain cartridges in multiple parallel offset rows. The partition walls 203 are further configured to control the lateral movement of cartridges 100 placed onto the receiving surface 201 by manipulating the positioning of the compartment spaces 206 on the receiving surface 201. The partition walls 203 further define distal narrow sides 205 located opposite to the proximal narrow sides 204 which are configured to couple with cartridge carriers 101 and segregate cartridges 100 on the cartridge carriers 101 into the partition wall compartment spaces 206 based on the vertical row configuration cartridges 100 are arranged in on the cartridge carrier 101, which is dependent on the orientation of the cartridge carrier 101 to the partition wall distal narrow sides 205. The distal narrow sides 205 define tapers 207 on the distal narrow sides 205 which assist in segregating cartridges 100 on a cartridge carrier 101 into the partition wall compartment spaces 206. The distance between the distal narrow sides 205 and the receiving surface 201 is configured to allow cartridges 100 on a cartridge carrier 101 coupled to the distal narrow sides 205 to move out from the cartridge carrier 101 into tangency with the receiving surface 201 while maintaining their bullet tips 103 or flat primer sides 104 in the cartridge carrier 101. The speed loading device 200 further defines an alignment wall 208 which runs parallel to the length of the speed loading device 200 throughout the length of the speed loading device 200. The alignment wall 208 is elongated perpendicularly to the receiving surface 201 and is coupled to the receiving surface 201 at the adjacent long edge 215. The alignment wall 208 is adjacent to the partition walls 203 and runs parallel to the partition walls 203. The alignment wall 208 defines an alignment surface 209 on a side of the alignment wall 208 facing toward the partition walls 203 which is configured level cartridges 100 urged against it by partition walls 203 into single file rows. The alignment wall 208 further defines a passage opening 210 located on the alignment surface 209 which runs through the alignment wall 208 that is configured to allow the passage of the partition walls 203 through the alignment wall 208. The speed loading device 200 further defines an obstructing wall 211 coupled to the receiving surface 201, at the receiving surface proximal short edge 202, which is elongated perpendicularly to the receiving surface 201. The obstructing wall 211 runs perpendicular to the alignment wall 208 and parallel to the width of the speed loading device 200 from the receiving surface opposite long edge 216 to a cartridge width away from the alignment surface 209. This cartridge wide gap 217 between the alignment surface 209 and the obstructing wall 211 is configured to allow passage of cartridges 100 from the receiving surface 201 to the receiving surface proximal short edge 202. The obstructing wall 211 is configured to maintain cartridges 100 on the receiving surface 201 when the speed loading device 200 is angled diagonal to the ground 400 with the receiving surface distal short edge 213 elevated above the receiving surface proximal short edge 202. The speed loading device 200 further defines a loading rod 212, which is a generally elongated rectangular bar that is sufficient in length to reach from the receiving surface distal short edge 213 to the receiving surface proximal short edge 202. The loading rod 212 defines a sliding surface 214, located on a long side of the loading rod 212, which is slideably engaged with the receiving surface 201 at the receiving surface distal short edge 213. The loading rod 212 defines an urging surface 218, located on a proximal long end of the loading rod 212, configured to travel adjacent to the alignment surface 209 and urge single filed cartridges 100 on the receiving surface 201 adjacent to the alignment surface 209 from the receiving surface 201 into the open end of a magazine 300 coupled to the receiving surface proximal short edge 202.

Figure 3:
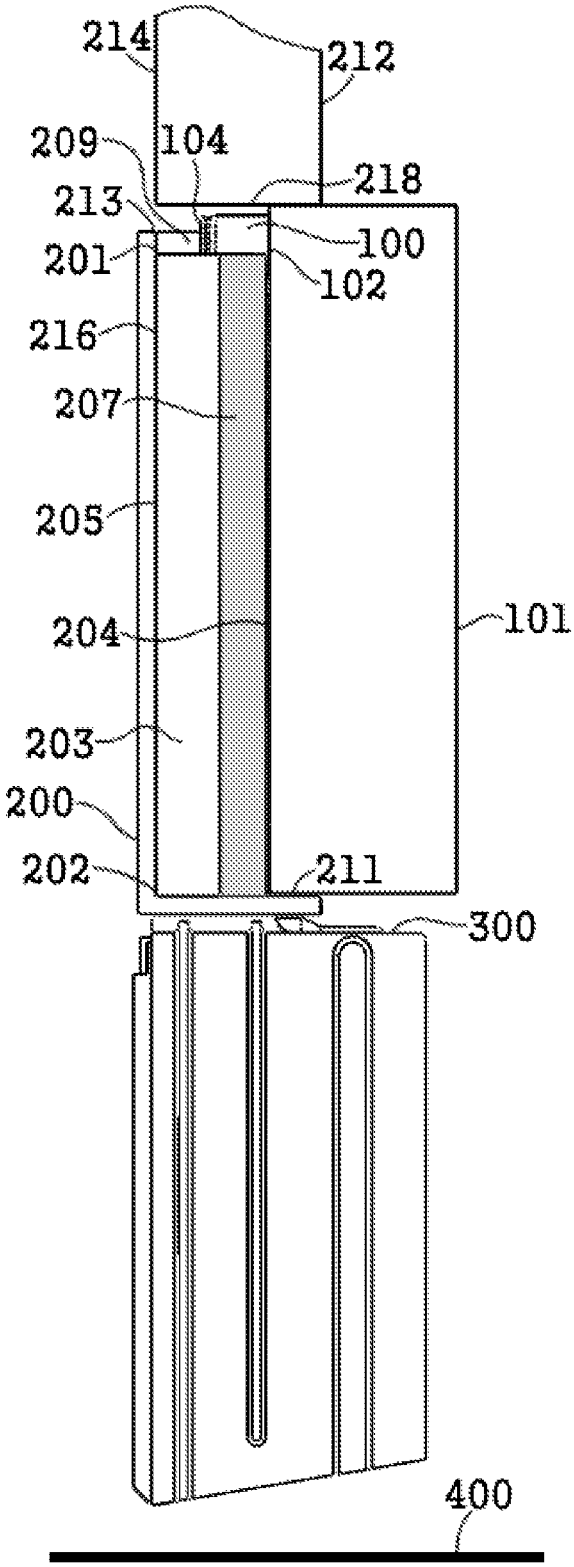
FIG. 3 is a side view of the preferred embodiment of the speed loading device coupled with the open end of a magazine and a cartridge carrier with cartridges.

In reference to example embodiments disclosed in FIG. 3, the open end of a magazine 300 is engaged with the speed loading device 200 at the receiving surface proximal short edge 202 in such a manner that the open end of the magazine 300 is adjacent to and parallel with the alignment surface 209 while aligned with the cartridge wide gap 217. The length of the speed loading device 200 is angled perpendicular to the ground 400 and a cartridge 100 bearing cartridge carrier 101, also with its length perpendicular to the ground, is coupled to the distal narrow sides 205 of the partition walls 203 at the side of the cartridge carrier 101 bearing the holding compartments 102. The distal narrow sides 205 is coupled with the cartridge carrier 101 in such a manner that cartridges 100 exposed in the holding compartments 102 of the cartridge 101 are facing toward the receiving surface 201, the cartridge flat primer sides 104 facing foremost toward the receiving surface 201. The cartridges 100, when coming into adjacency with the partition walls 203, are segregated and compartmentalized by the partition walls 203 into each of the compartment spaces 206 of the partition walls 203 according to the vertical rows in which cartridges 100 are arranged in on the cartridge carrier 102.

Figure 4A:
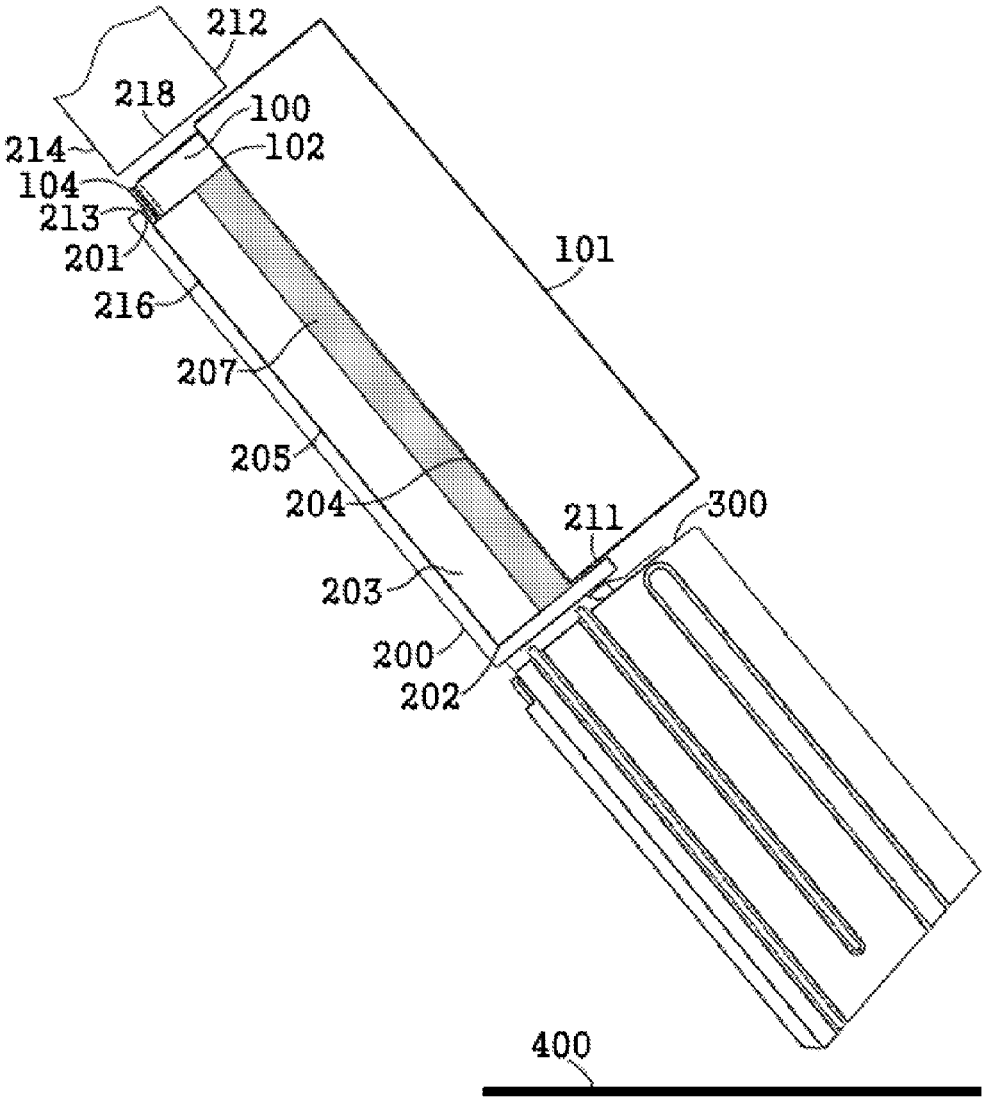
FIG. 4A is a side view of the preferred embodiment of the speed loading device receiving cartridges from a cartridge carrier while angled diagonal to the ground.
Figure 4B:
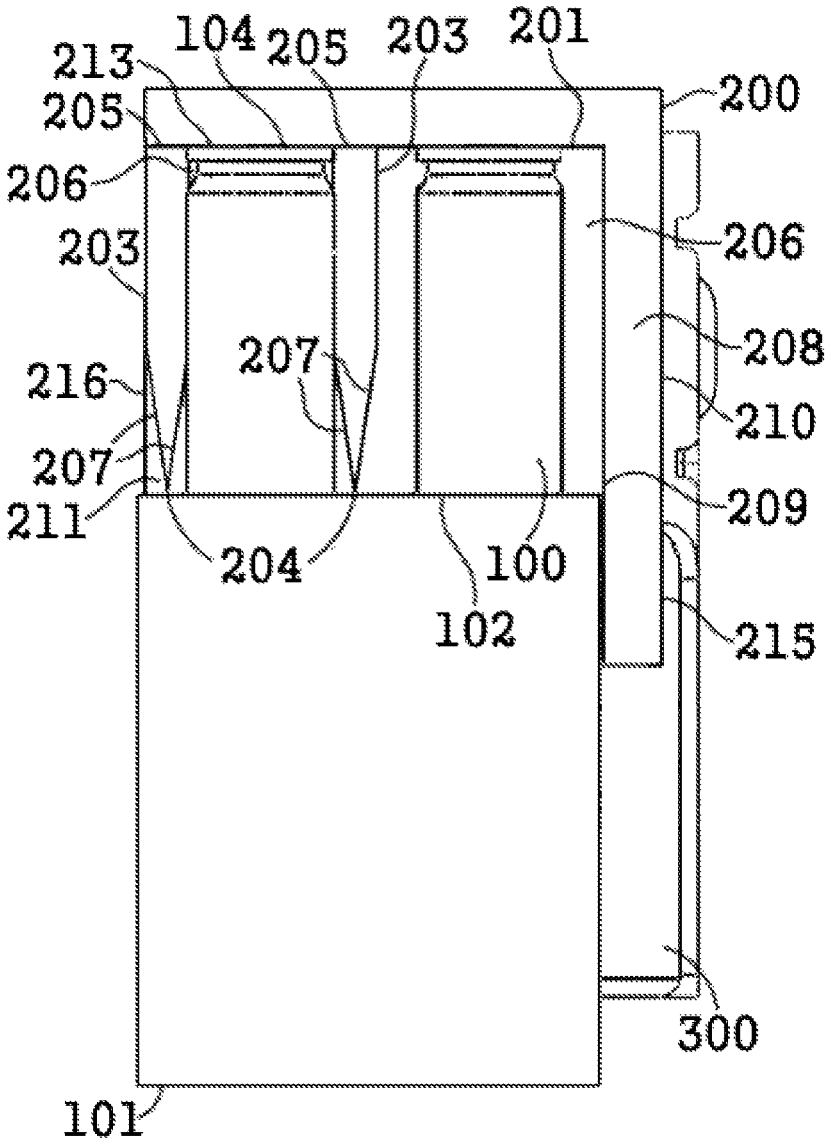
FIG. 4B is a top cross section view of the preferred embodiment of the speed loading device receiving cartridges from a cartridge carrier while angled diagonal to the ground.

In reference to example embodiments disclosed in FIG. 4, the speed loading device 200 and cartridge carrier 101 are tilted to be parallel or diagonal to the ground 400 with the cartridge carrier 101 placed over the speed loading device 200 in order to shift the support of the cartridges 100 from the cartridge carrier 101 to the speed loading device 200 by force of gravity. Cartridges 100 slide partially out from the holding compartments 106 of the cartridge carrier 101 and the flat primer sides 104 of the cartridges 100 come into contact with the receiving surface 201. As support of the cartridges 100 shifts from the cartridge carrier 100 onto the receiving surface 201, the bullet tips 103 of the cartridges 100 are still maintained in the cartridge carrier 101. The speed loading device 200 and cartridge carrier 101 are tilted so the distal short edge 213 of the receiving surface 201 is elevated over the proximal short edge 202, with the cartridge carrier 101 over the speed loading device 200, to influence the flat primer sides 104 of cartridges 100 to lean toward the receiving surface proximal short edge 202. This allows cartridges 100 to move on the receiving surface 201 in the direction of the receiving surface proximal short edge 202 with a lower likelihood of the lengths of cartridges 100 pitching to become parallel with the length of the speed loading device 200.

Figure 5:
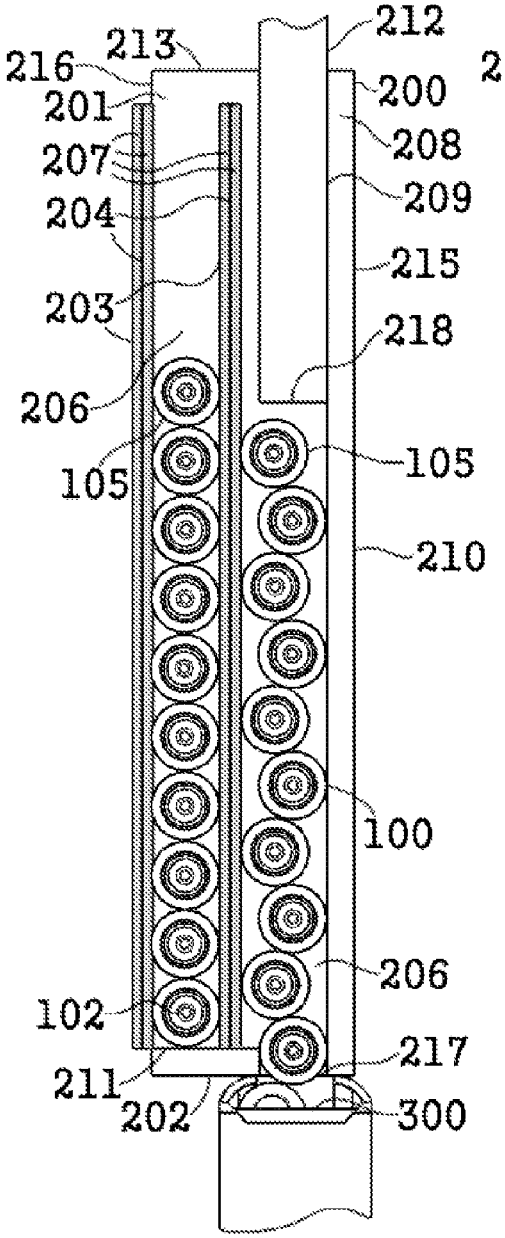
FIG. 5 is a frontal view of the preferred embodiment of the speed loading device with cartridges compartmentalized in the compartment spaces in single row and double parallel offset row configurations.

In reference to example embodiments disclosed in FIG. 5, the cartridge carrier 101 is decoupled from the distal narrow sides 205 of the partition walls 203 and from the cartridges 100 and is lifted from tangency with the distal narrow sides 205 and the cartridges 100. By force of gravity, cartridges 100 move in tangency with the receiving surface 201 toward the receiving surface proximal short edge 202 until coming into contact with the obstructing wall 211 or the open end of the magazine 300 coupled to the receiving surface proximal short edge 202. In an embodiment, the cartridges 100 compartmentalized in the compartment spaces 206 are held in single files per compartment space 206. In another embodiment, the cartridges 100 compartmentalized in the compartment spaces 206 are held in dual parallel offset rows per compartment space 206.

Figure 6A:
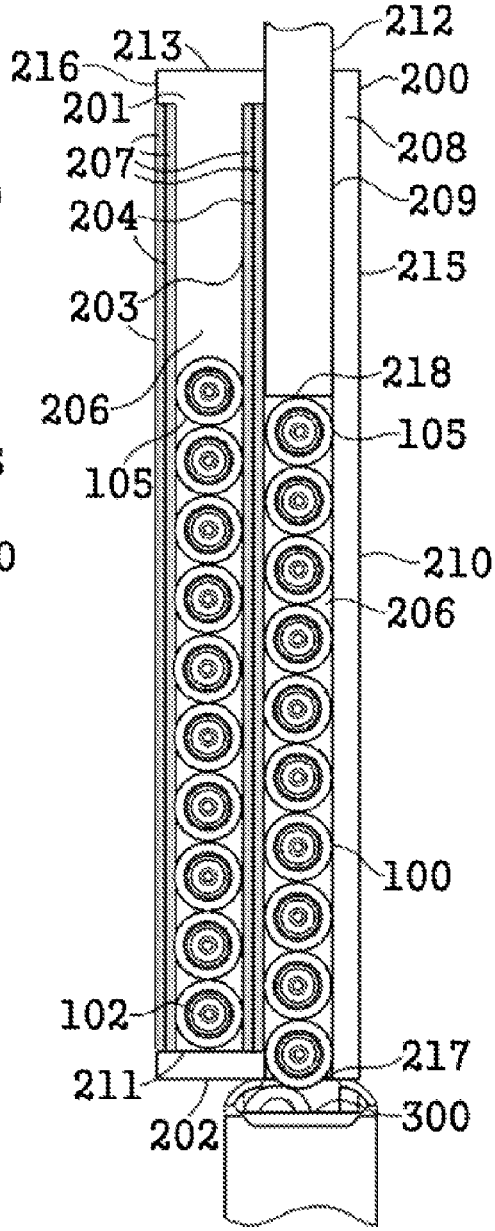
FIG. 6A is a frontal view of the compartment of cartridges adjacent to the alignment wall of the preferred embodiment leveled into a single row against the alignment wall by urging of the partition wall adjacent to the cartridges.
Figure 6B:
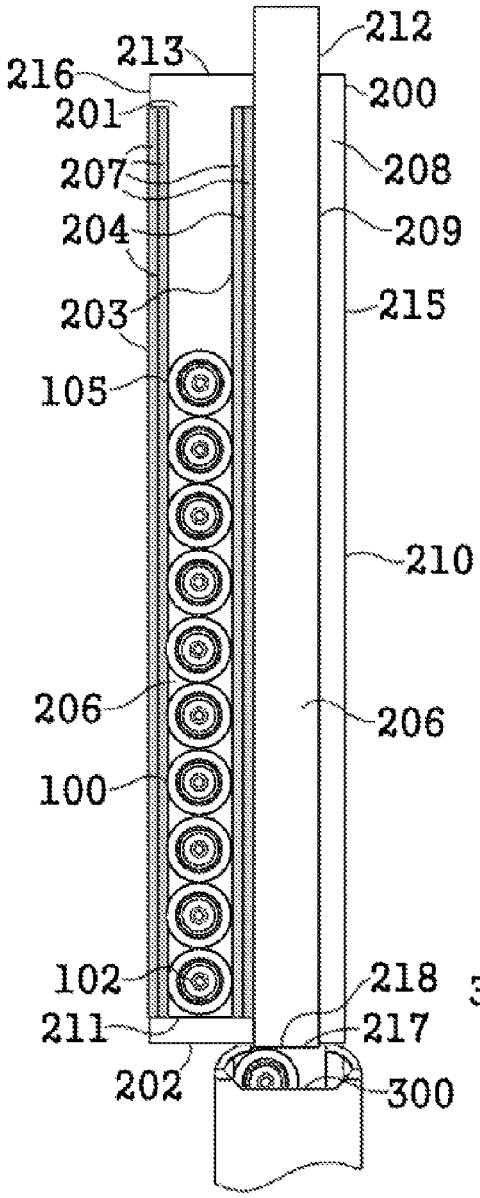
FIG. 6B is a frontal view of the compartment of cartridges adjacent to the alignment wall of the preferred embodiment urged into the open end of the magazine by the loading rod.

In reference to example embodiments disclosed in FIGS. 6A and 6B, cartridges 100 held in the compartment space 206 immediately adjacent to the alignment surface 209 of the alignment wall 208 are urged against the alignment surface 209 by urging the partition walls 203 toward the alignment surface 209. These cartridges 100, being urged against the alignment surface 209 by a partition wall 203 immediately adjacent to the cartridges 100, become level with the alignment surface 209 and form a single file row that is parallel with the length of the alignment surface 209 and aligned with the cartridge wide gap 217. The partition wall 203 immediately adjacent to the single filed cartridges 100 works in conjunction with the alignment surface 209 in forming a loading chamber one cartridge width wide that facilitates the urging and directing of cartridges 100 from the receiving surface 201 through the cartridge wide gap 217 into the open end of the magazine 300 by the pressing rod 212. The sliding surface 214 of the loading rod 212 is slideably engaged with the receiving surface 201 at the receiving surface distal short edge 213 with the urging surface 218 of the pressing rod 212 facing toward the receiving surface proximal short edge 202. The urging surface 218 is slid away from the receiving surface distal short edge 213 toward the receiving surface proximal short edge 202 and comes into contact with the top cartridge 105 of the single filed cartridges 100 adjacent to the alignment surface 209. The urging surface 218 urges the top cartridge 105, which in turn urges the entire file of cartridges 100 adjacent to the alignment surface 209, through the cartridge wide gap 217 into the open end of the magazine 300. The loading rod 212 is then retracted back to the receiving surface distal short edge 213 and the loading rod sliding surface 214 is disengaged from the receiving surface 201.

Figure 7:
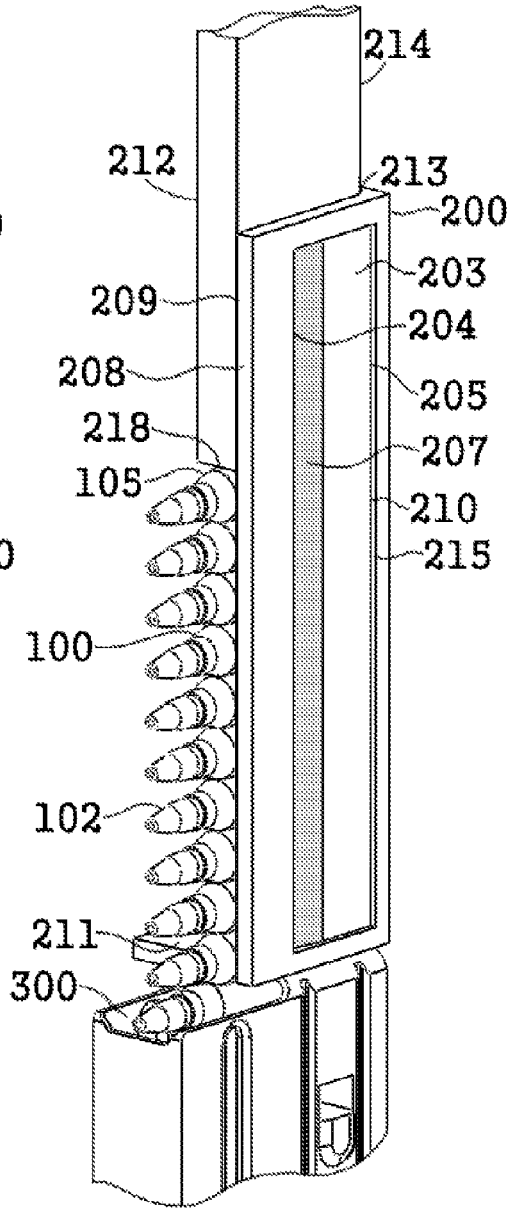
FIG. 7 is a side angle view of a successive compartment of cartridges leveled into a single row against the alignment wall of the preferred embodiment by urging of a successive partition wall.

In reference to example embodiments disclosed in FIG. 7, the partition wall 203 that was immediately adjacent to the file of cartridges 100 urged into the open end of the magazine 300 is urged through the passage opening 210 of the alignment wall 208 and the next successive compartment space 206 with cartridges 100 is brought into adjacency with the alignment surface 209. The cartridges 100 in the successive compartment space 206 are urged against the alignment surface 209 by the partition wall 203 immediately adjacent to the cartridges 100, which has not been passed through the alignment wall 208, and become leveled with the alignment surface 209 into a single file row aligned with the cartridge wide gap 217. The immediately adjacent partition wall 203, which has not been passed through the alignment wall 208, works in conjunction with the alignment surface 209 in forming a loading chamber one cartridge width wide that facilitates the urging and directing of cartridges 100 adjacent to the alignment surface 209 through the cartridge wide gap 217 into the open end of the magazine 300. The sliding surface 214 of the loading rod 212 is slideably engaged with the receiving surface 201 at the receiving surface distal short edge 213 with the urging surface 218 of the receiving surface 201 facing toward the receiving surface proximal short edge 202. The urging surface 218 is slid from the receiving surface distal short edge 213 toward the receiving surface proximal short edge 202 and comes into contact with the top cartridge 105 of the single filed cartridges 100 adjacent to the alignment surface 209. The urging surface 218 urges the top cartridge 105, which in turn urges the entire file of cartridges 100 adjacent to the alignment surface 209, through the cartridge wide gap 217 into the open end of the magazine 300.

The invention claimed is:

1. A method for loading ammunition from a cartridge carrier into a magazine, comprising:

coupling a cartridge carrier with cartridges onto a loading device, the loading device including partition walls, the partition walls laterally movable along a receiving surface, the receiving surface perpendicular to an alignment wall;

transferring the cartridges from the cartridge carrier onto the receiving surface to form single file rows of cartridges on the receiving surface;

decoupling the cartridge carrier from the cartridges and the partition walls;

coupling an open end of a magazine relative to the receiving surface;

urging the partition walls and the single file rows of cartridges toward the alignment wall and successively urging the single file rows of cartridges from the receiving surface into the open end of the magazine.

2. The method of claim 1, wherein the coupling the cartridge carrier includes coupling the cartridge carrier relative to the partition walls so that the cartridges on the cartridge carrier are exposed from the cartridge carrier toward the receiving surface.

3. The method of claim 2, wherein flat primer sides of the cartridges face toward the receiving surface during the coupling the cartridge carrier.

4. The method of claim 1, further comprising segregating with the partition walls the cartridges on the cartridge carrier according to vertical rows in which the cartridges are arranged on the cartridge carrier.

5. The method of claim 1, wherein the urging the partition walls results in the cartridges being leveled into a single file row of the cartridges against the alignment wall and linearly aligned with the open end of the magazine.

6. The method of claim 1, wherein the alignment wall has a passage opening through which at least a first partition wall of the partition walls can pass through the alignment wall.

7. The method of claim 1, wherein the successively urging the single file rows of cartridges includes urging the single file rows of cartridges from the receiving surface into the open end of the magazine with a rod.

8. The method of claim 1, wherein the cartridge carrier is a box.

9. The method of claim 1, wherein the cartridge carrier is a tray.

10. The method of claim 1, wherein the partition walls are laterally movable along the receiving surface in tandem with one another.

11. The method of claim 1, wherein the transferring is facilitated by gravity.

12. The method of claim 11, wherein the transferring includes angling the partition walls and the cartridge carrier to be diagonal or parallel to ground with the cartridge carrier above the receiving surface.

13. The method of claim 1, wherein the coupling includes coupling the cartridge carrier onto the partition walls so that the cartridges are prevented from moving completely out of the cartridge carrier while the cartridge carrier is coupled to the partition walls.

14. A speed loading device for loading cartridges into a magazine, the speed loading device comprising:

a generally elongated receiving surface having a front face, a proximal long edge, and a proximal short edge, the front face configured to slideably engage with cartridges, and the proximal short edge configured to engage with an open end of a magazine for receiving cartridges from the speed loading device;

an alignment wall, the alignment wall running a length of the receiving surface along the proximal long edge of the receiving surface;

an obstructing wall, the obstructing wall running perpendicular to the alignment wall and the receiving surface along the proximal short edge of the receiving surface;

multiple parallel partition walls slideably and laterally movable relative to the receiving surface and toward and away from the alignment wall, the partition walls configured to couple with boxes or trays of cartridges; and a generally elongated loading rod having a long side and a short end, the long side configured to be slideably engaged with the receiving surface and the short end configured to urge cartridges along the receiving surface.

15. The speed loading device of claim 14, wherein the alignment wall and the multiple partition walls are parallel to one another.

16. The speed loading device of claim 14, wherein the obstructing wall runs from an edge of the receiving surface opposite the proximal long edge to a cartridge width from the alignment wall.

17. The speed loading device of claim 16, wherein the proximal short edge of the receiving surface is configured to engage with the open end of the magazine in such a manner that the open end of the magazine is aligned with a cartridge wide space between the alignment wall and the obstructing wall.

18. The speed loading device of claim 14, wherein sides of the partition walls distal the receiving surface are tapered.

19. The speed loading device of claim 14, wherein the partition walls, the obstructing wall, and the alignment wall are elongated perpendicularly to the receiving surface.

20. The speed loading device of claim 14, wherein the alignment wall has an opening, and wherein the multiple parallel partition walls are configured so that responsive to being urged toward the alignment wall, at least a first partition wall of the multiple parallel partition walls extends into the opening.

21. A device for loading cartridges into a magazine, the device comprising:

a receiving surface positioned to receive rows of cartridges from a cartridge carrier, the receiving surface having a length and a width;

an alignment wall extending from a long edge of the receiving surface along the length of the receiving surface;

an obstructing wall extending from a short edge of the receiving surface along a portion of the width of the receiving surface, wherein the obstructing wall is spaced away from the alignment wall such that the obstructing wall, the alignment wall, and the receiving surface collectively define a gap that is sized to permit cartridges to slide from the receiving surface into a magazine that is positioned adjacent to the gap;

two spaced-apart partition walls operatively coupled relative to the receiving surface, wherein the partition walls are parallel to the alignment wall and perpendicular to the obstructing wall, wherein the partition walls and the alignment wall are configured to facilitate receipt of two rows of cartridges from a cartridge carrier onto the receiving surface, and wherein the partition walls are configured to translate laterally relative to the receiving surface toward the alignment wall for sequential alignment of the two rows of cartridges with the gap; and a loading rod configured to operatively and sequentially urge the two rows of cartridges from the receiving surface into a magazine that is positioned adjacent to the gap.

22. The device of claim 21, wherein the alignment wall defines a passage opening sized to receive at least a first partition wall of the two spaced-apart partition walls; and wherein the two spaced-apart partition walls are operatively coupled relative to the receiving surface so that the first partition wall extends into the passage opening responsive to the partition walls being urged toward the alignment wall.

23. The device of claim 21, wherein the two spaced-apart partition walls are further configured to translate laterally relative to the receiving surface to facilitate adjustment of spacing between the partition walls and the alignment wall for alignment with rows of cartridges from a cartridge carrier.

24. A method of loading a magazine, the method comprising:

providing the device of claim 21, wherein the two spaced-apart partition walls include a first partition wall and a second partition wall;

positioning a magazine adjacent to the gap;

providing a cartridge carrier having cartridges held in the cartridge carrier;

positioning the cartridge carrier relative to the device so that a first row of cartridges held in the cartridge carrier is positioned between the alignment wall and the first partition wall on the receiving surface adjacent to the gap and so that a second row of cartridges held in the cartridge carrier is positioned between the first partition wall and the second partition wall on the receiving surface adjacent to the obstructing wall;

following the positioning the cartridge carrier, removing the cartridge carrier from the device so that the cartridges remain on the receiving surface;

following the positioning the magazine and the removing the cartridge carrier, urging the first row of cartridges with the loading rod through the gap and into the magazine;

following the urging the first row of cartridges, translating the partition walls toward the alignment wall so that the second row of cartridges is aligned with the gap; and following the translating the partition walls, urging the second row of cartridges with the loading rod through the gap and into the magazine.

25. The method of claim 24, further comprising:

following the removing the cartridge carrier and prior to the urging the first row of cartridges, maintaining the first and second row of cartridges in single file rows by urging the partition walls toward the alignment wall.

26. The method of claim 24, further comprising:

adjusting spacing between the partition walls and the alignment wall to facilitate the positioning the cartridge carrier and receipt of the first row and second row of cartridges on the receiving surface.

* * * * *